US005913259A

United States Patent [19]

Grubb et al.

[11] Patent Number: 5,913,259

[45] Date of Patent: Jun. 15, 1999

[54] SYSTEM AND METHOD FOR STOCHASTIC SCORE FOLLOWING

[75] Inventors: Lorin V. Grubb, Dover; Roger B. Dannenberg, Pittsburgh, both of Pa.

[73] Assignee: Carnegie Mellon University, Pittsburgh, Pa.

[21] Appl. No.: 08/935,393

[22] Filed: Sep. 23, 1997

[51] Int. Cl.[6] ..... G10H 1/36; G10H 7/00

[52] U.S. Cl. ..... 84/610; 84/612

[58] Field of Search ..... 84/600, 610, 612, 84/634, 636

[56] References Cited

U.S. PATENT DOCUMENTS

| | | | |
|---|---|---|---|
| 4,745,836 | 5/1988 | Dannenberg . | |
| 5,521,324 | 5/1996 | Dannenberg et al. . | |
| 5,648,627 | 7/1997 | Usa | 84/600 |

FOREIGN PATENT DOCUMENTS

| | | |
|---|---|---|
| 0477869A2 | 4/1992 | European Pat. Off. . |
| WO 9535562 | 12/1995 | WIPO . |

OTHER PUBLICATIONS

Dannenberg, et al., "Practical Aspects of a Midi Conducting Program", Proceedings of the 1991 International Computer Music Conference, pp. 537–540.

Puckette, M., "Score Following Using the Sung Voice", Proceedings of the 1995 International Computer Music Conference, pp. 175–178.

Inoue, W. et al., "A Computer Music System for Human Singing", Proceedings of the 1993 International Computer Music Conference, pp. 150–153.

Inoue, W. et al., "Adaptive Karaoke System", Proceedings of the 1994 International Computer Music Conference, pp. 70–77.

Katayose, H. et al., "Virtual Performer", Proceedings of the 1993 International Computer Music Conference, pp. 138–145.

Bloch, J. et al., "Real–Time Computer Accompaniment of Keyboard Performances", Proceedings of the 1985 International Computer Music Conference.

*Primary Examiner*—David Martin
*Assistant Examiner*—Jeffrey W. Donels
*Attorney, Agent, or Firm*—Kirkpatrick & Lockhart LLP

[57] ABSTRACT

The present invention is directed to a computer implemented method for stochastic score following. The method includes the step of calculating a probability function over a score based on at least one observation extracted from a performance signal. The method also includes the step of determining a most likely position in the score based on the calculating step.

32 Claims, 6 Drawing Sheets

SYSTEM AND METHOD FOR STOCHASTIC SCORE FOLLOWING

BACKGROUND OF THE INVENTION

1. Field of the Invention

The present invention is directed generally to automated score following systems and methods, and, more particularly, to a stochastic score following system and method.

2. Description of the Background

Automated musical accompaniment systems are computer systems designed to accept a musical score as input and to provide real-time performance of the accompaniment in synchrony with one or more live soloists. Automated accompaniment systems must concurrently execute several tasks within the real-time constraints of musical performance. First, these systems must observe the soloists by detecting what they have performed. If the soloists' performances do not involve electronic instruments, this will likely require some form of audio signal processing to extract relevant features, such as fundamental pitch. Second, accompaniment systems must track the soloists as they perform the score. Tracking often involves both identifying the soloists' current score position and estimating the soloists' tempo. Third, the systems must react to the soloists by tastefully performing the accompaniment, generally attempting to synchronize the accompaniment with live performers. Finally, accompaniment systems must generate the actual sound for the accompaniment. Sound production is usually accomplished by either controlling audio synthesizers or by directly generating digital audio.

Several systems for accompanying a vocal performer have been previously described in Katayose, et al., "Virtual Performer", Proc. of the 1993 Intl. Computer Music Conference, 1993, pp. 138–45; Inoue et al., "A Computer Music System for Human Singing", Proc. of the 1993 Intl. Computer Music Conference, 1993, pp. 150–53; Inoue, et al., "Adaptive Karaoke System—Human Singing Accompaniment Based on Speech Recognition", Proc. of the 1994 Intl. Computer Music Conference, 1994, pp. 70–77; and Puckette, "Score Following Using the Sung Voice", Proc. of the 1995 Intl. Computer Music Conference, 1995, pp. 175–78. The first three systems accompany amateur vocalists performing pop music. The first two rely on pitch detection for tracking the performer, and the third applies speech processing techniques for vowel recognition. These systems attempt to identify both the score position and the tempo of the performer, and to adjust the computer accompaniment in response. The fourth system was used to accompany a contemporary art piece written for computer and soprano. It relied on pitch detection and did not attempt to determine the tempo of the performer. Rather, it was designed for fast identification of soloist notes that were scored to coincide with computer generated sounds.

The designers of these systems commonly report certain problems that complicate the tracking of a vocalist. These include variation of detected features, such as pitch, resulting from accidental and intentional actions on the part of performers. In addition, methods for pitch detection and vowel detection are generally not themselves error-free. Consequently, all of these systems incorporate heuristics or weighting schemes intended to compensate for mistakes made when features are directly matched against the score.

Thus, there is a need for a system and method for tracking a performer that is based upon a probabilistic description of the performer's score position. The system and method must use a variety of relevant information, including recent tempo estimates, features extracted from the performance, and elapsed time. Unlike previous systems and methods, such a system and method should not require subjective weighting schemes or heuristics and should use either formally derived or empirically estimated probabilities to describe the variation of the detected features and other relevant data. Furthermore, such a system and method should use such features even if they contribute varying degrees of information toward the estimation of score position.

In addition, there is a need for a score following model that can be efficiently implemented on low-end personal computers, so as to satisfy the real-time constraints imposed by musical accompaniment.

SUMMARY OF THE INVENTION

The present invention, according to its broadest implementation, is directed to a computer implemented method for stochastic score following. The method includes the steps of calculating a probability function over a score based on at least one observation extracted from a performance signal and determining a most likely position in the score based on the calculating step.

The present invention has the advantage that it tracks a performer using a stochastic description of the performer's score position. Such an approach has the advantage that it does not require subjective weighting schemes or heuristics and instead uses either formally derived or empirically estimated probabilities to describe the variation of the detected features and other relevant data. This approach has the further advantage that observations which exhibit varying degrees of information with respect to estimating score position are combined. The present invention has the further advantage that it can be efficiently implemented on low end personal computers and thus satisfies the real time constraints imposed by musical accompaniment.

BRIEF DESCRIPTION OF THE DRAWINGS

For the present invention to be clearly understood and readily practiced, the present invention will be described solely for purposes of illustration and not limitation, in conjunction with the following figures, wherein.

DETAILED DESCRIPTION OF THE PREFERRED EMBODIMENTS

It is to be understood that the figures and descriptions of the present invention have been simplified to illustrate elements that are relevant for a clear understanding of the present invention, while eliminating, for purposes of clarity, other elements found in a typical automated musical accompaniment system. Those of ordinary skill in the art will recognize that other elements are desirable and/or required to implement the present invention. However, because such elements are well known in the art, and because they do not facilitate a better understanding of the present invention, a discussion of such elements is not provided herein.

Figure 1:
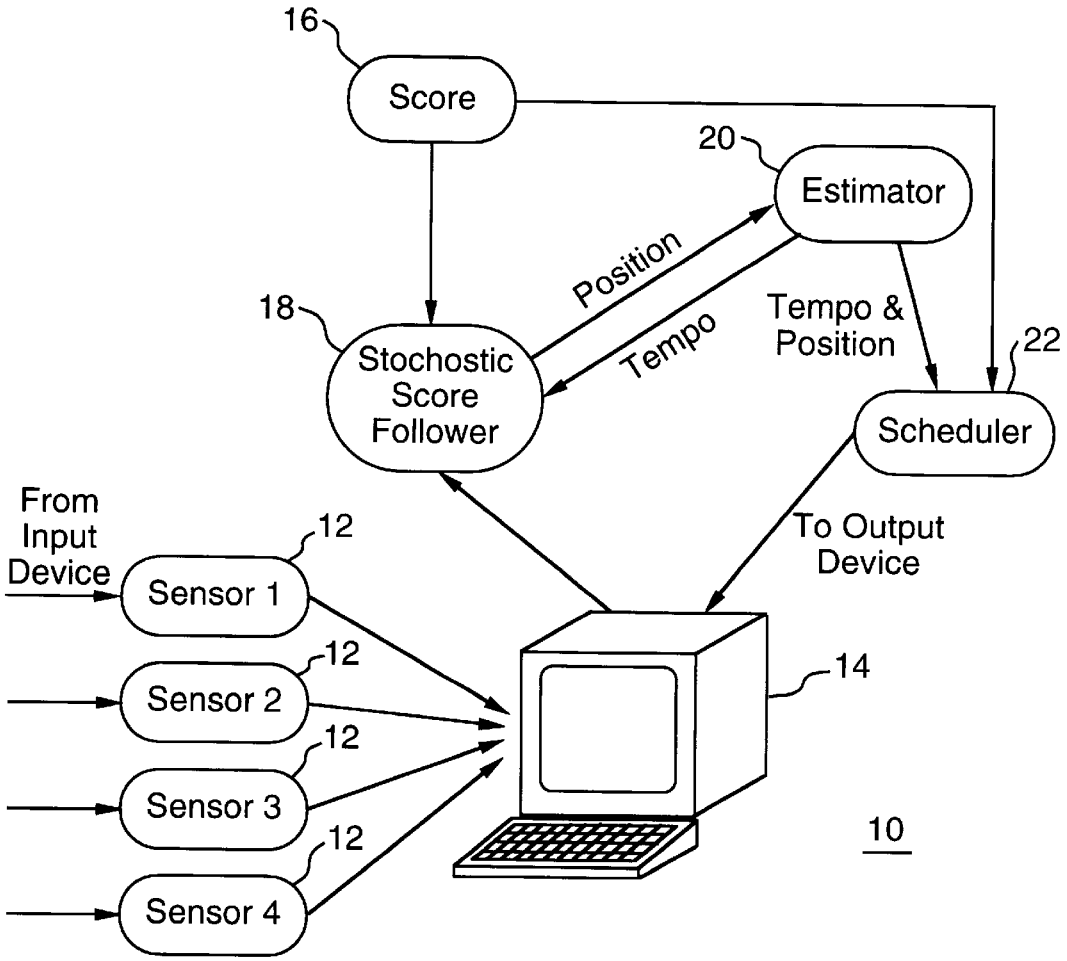
FIG. 1 illustrates a system diagram of an accompaniment system constructed according to the present invention.

FIG. 1 illustrates a system diagram of an accompaniment system 10 constructed according to the teachings of the present invention. Sensors 12 receive input signals from input devices (not shown). The input devices may be, for example, microphones or other devices such as switches, pressure transducers, strain gauges, and the like. The input sensors 12 produce time-stamped observations from the input device signals.

The time-stamped observations are input to a computer 14. The computer 14 may be a workstation, such as a Sun Sparcstation or an IBM RISC 6000, a personal computer, such as an IBM compatible PC or an Apple Macintosh, or an application-specific integrated circuit (ASIC). A musical score 16 is stored in the computer 14. The musical score 16 may be stored in a memory device, such as a random access memory (RAM) or a read only memory (ROM), or may be stored on a disk, such as a CD-ROM, a magnetic hard disk, or a floppy disk. A musical score will often consist of one or more solo parts and an accompaniment. In the case of Western classical music written for a single vocalist, the solo part will consist of a sequence of notes, each note indicating at least pitch, a syllable to be sung, and relative duration. Other information, such as dynamic and articulation, may also be specified. Also, the tempo for a given piece will likely vary within a single performance, as well as across performances. Tempo variations may be explicitly written in the score by the composer, or may be the result of conscious choices made by the performer.

A stochastic score follower module 18 receives the time-stamped observations and the score and calculates an updated score position density function as described more fully below. From the time-stamped observation, a prior score position density function, a tempo estimate, and elapsed time, the stochastic score follower module 18 computes an updated score position density function and uses that function to select the most likely position of the performer in the score. The position is input to an estimator module 20, which estimates a tempo based on a sequence of present and past position estimates. The tempo is fed back to the stochastic score follower module 18.

The estimated position, tempo information, and the score are input to a scheduler module 22. The scheduler module 22 compares the estimated position and tempo to the position and tempo currently being played. The scheduler module 22 adjusts the position and tempo to compensate for any differences based on the comparison. The scheduler module 22 produces an output signal that is used by an output device (not shown), which performs the accompaniment score. In the preferred embodiment, the stochastic score follower 18, the estimator 20, and the scheduler 22 modules are implemented in software and stored in a memory device within the computer 14 as a series of instructions or commands.

Figure 2:
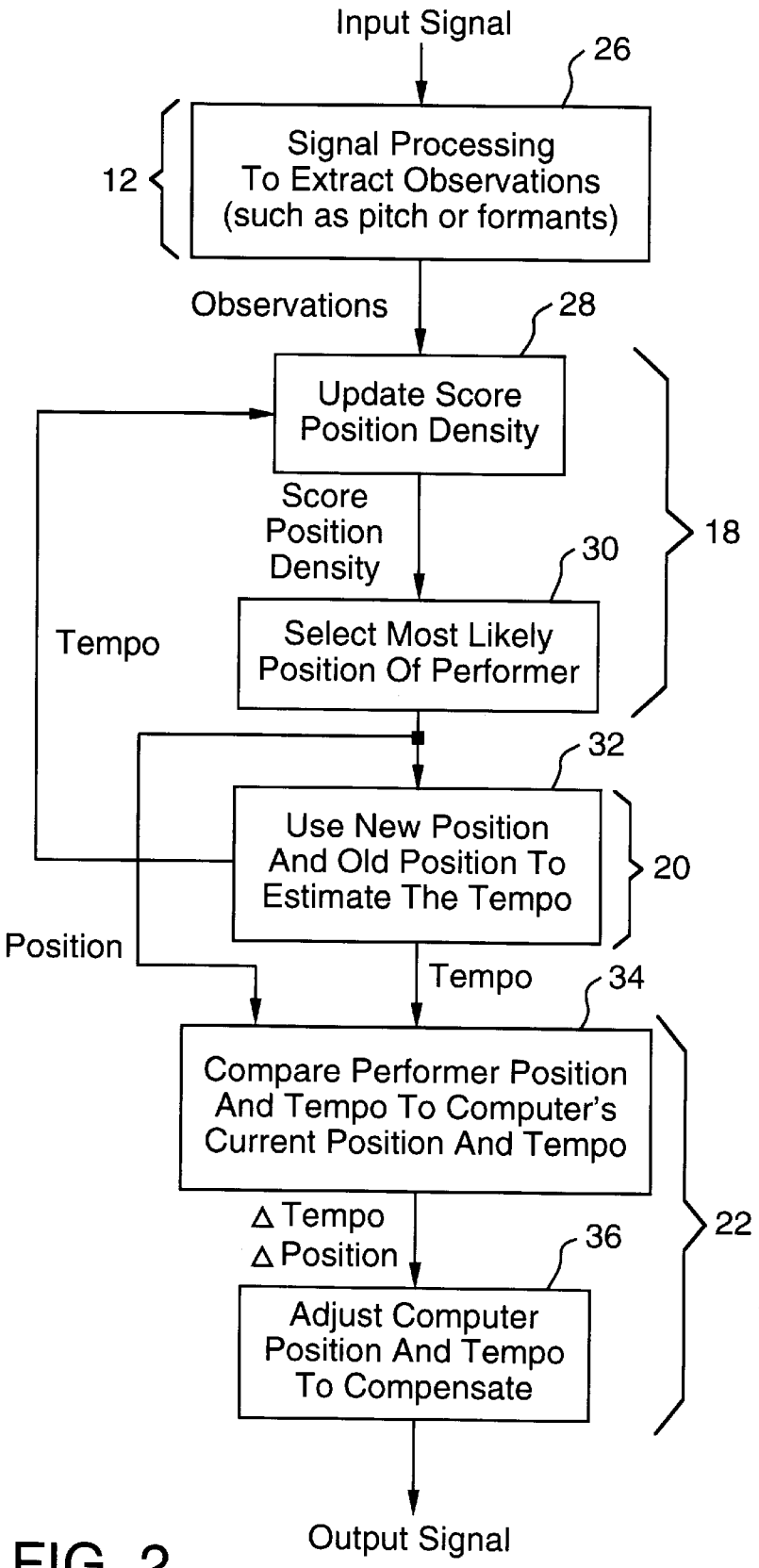
FIG. 2 illustrates the sequence of computations carried out by the system shown in FIG. 1.

FIG. 2 illustrates the sequence of computations used by the accompaniment system 10 of the present invention to receive a performance and output a score position and tempo to a musical accompaniment output device. In the simplest case, a signal representing a solo performance is produced by an input device (not shown), and received by the sensor 12. The sensor 12 processes the signal at step 26 to extract observations, such as pitch or formants, and add a time-stamp. The processed signal is input to the stochastic score follower module 18. The stochastic score follower module 18 updates a score position density function, described more fully below, at step 28. The module 18 then uses the updated score position density function to select the most likely position of the performer at step 30.

The newly calculated position and the prior position of the performer are used by the estimator module 20 to estimate the tempo of the performer at step 32. Tempo estimation is performed using techniques well known in the art. For example, the techniques disclosed in Dannenberg, R. et al., "Practical Aspects of a Midi Conducting Program," Pro. of the 1991 Intl. Computer Music Conference, 1991, pp. 537–40, which is incorporated herein by reference, can be used. The tempo estimate is fed back for use in the score position density update step 28.

At step 34, the performer's estimated position in the score and the estimated tempo that was computed in step 32 are compared by the scheduler module 22 to the accompaniment computer's current position in the score and current tempo. The results of the comparison are used to adjust the accompaniment position and tempo at step 36 to compensate for any differences. Techniques for the generation of an accompaniment are well known in the art. For example, the techniques disclosed in Bloch, J. et al., "Real-Time Computer Accompaniment of Keyboard Performances," Proc. of the 1985 Intl. Computer Music Conference, 1985, pp. 279–80, which is incorporated herein by reference, can be used.

The model used by the present invention to track a vocalist represents the vocalist's part as a sequence of events that have a fixed, or at least a desired, ordering. Each event may be specified by:

1. A relative length which defines the size or duration of the event, as indicated in the score, relative to other events in the score.
2. An observation distribution which completely specifies the probability of every possible sensor output at any time during the event.

The relative length may be specified in beats for a fixed tempo, or in some units of time resulting from the conversion of beats to "idealized time" using a fixed, idealized tempo. The length is assumed to be real-valued and not necessarily a positive integer.

The vocalist's part in the score is thus viewed as a sequence of events, with each event spanning a region of the number line. The score position of a singer is represented as a real number, assuming a value between 0 and the sum of the lengths of all events in the score. Score position is thus specified in either idealized beats or idealized time, and can indicate the performer's location at a granularity finer than an event.

Figure 3:
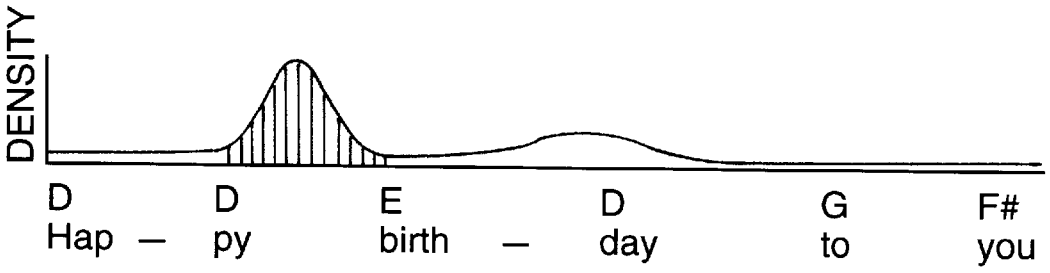
FIG. 3 illustrates an example of a function representing the probability that a performer is in a certain region of a score.

At any point while tracking an actual performance, the position of the vocalist is represented stochastically as a density function over score position. This is illustrated in FIG. 2 as the step of 28 updating the score position density function. The area under this function between two score positions indicates the probability that the performer is within that region of the score. An example of this is depicted in FIG. 3. The area over the entire length of the score is always 1, indicating it is 100% likely that the performer is in the score. As the performance progresses and subsequent observations (detected features) are reported, the score position density is updated to yield a probability distribution describing the performer's new location.

The observation distribution for each event specifies the probability of observing any possible value of a detected feature when the vocalist is performing that event. This distribution will generally be conditioned on information provided in the score. For example, if pitch detection is applied to the performance, then the observation distribution for a given event might specify for each pitch the likelihood that the sensor 12 will report that pitch, conditioned on the pitch written in the score for that event. As another example, distributions might also describe the likelihood of detectable spectral features that are correlated with sung phonemes.

Figure 4A:
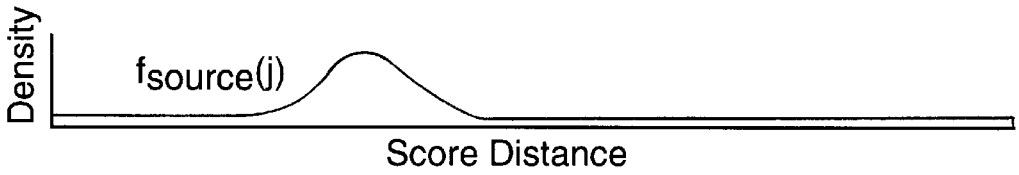
FIG. 4A illustrates a prior estimate of a score position as a function specifying the probability density given the score distance.
Figure 4B:
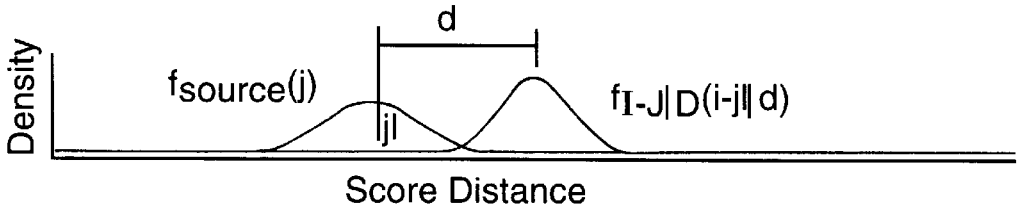
FIG. 4B illustrates the two functions participating in a convolution integral which is used to compute a preliminary score position density function.

In the present invention, the current score position density function and the observation distributions are used to estimate a new score position density for each new observation. FIGS. 3 and 4A illustrate prior estimates of score position as a function specifying the probability density given the score distance. FIG. 4B illustrates the two functions participating in a convolution integral, as more fully described hereinbelow, which are used to compute a preliminary score position density function. The preliminary density is then combined with the observation density function illustrated in FIG. 4C. FIG. 4D illustrates the final updated score position density function. This updated density indicates the probability of the current location of the performance in the score. In practice, calculating a new or updated score position density function requires a number of simplifications, assumptions, and approximations.

The model for updating the score position density function incorporates three pieces of information that are relevant to determining the new position of the performer, which is referred to as the performer's destination position. First, because a performer's rendering of a musical score is highly sequential, it is important to consider the performer's location at the time of the previous observation. This location will be referred to as the performer's source position. Second, the observation most recently extracted from the performance will obviously provide information about the performer's current location. Finally, performers often attempt to maintain a consistent tempo, subject to relatively minor and gradual variations. An estimate of the performer's tempo in the recent past, along with the elapsed time since the score position density was last updated, can give a useful prediction of how much score was performed during that elapsed time. This prediction is referred to as the estimated distance traversed, or simply the estimated distance.

Given these three variables—previous position, most recent observation, and estimated score distance traversed by the performer—the current location of the performer can be specified stochastically by the following conditional probability density:

$$f_{I|D,V,J}(i|d,\ v,\ j) \tag{1}$$

where:

i=the performer's destination position d=the estimated distance v=the observation j=the performer's source position Unfortunately, directly defining this multidimensional function for each and every score would be very challenging. Also, the previous score position of the performer is never known with certainty, so the value of at least one conditioning variable, j, should also be described stochastically. This can be accommodated by performing the following integration:

$$f_{I|D,V}(i\mid d,\ v) = \int_{j=0}^{\|Score\|} f_{I|D,V,J}(i\mid d,\ v,\ j)\cdot f_{J|D,V}(j\mid d,\ v)\partial j \tag{2}$$

where ||Score|| represents the length of the score. Note that additional integration would be required if the values of the estimated distance, d, and observation, v, were also specified stochastically.

While this formulation is a good starting point and very comprehensive, it is impractical for direct implementation. Because some of the functions in the integral are likely to be specified numerically, a closed-form solution is not possible. Also, the density functions are conditioned on so many parameters that estimating them from real data would require a large number of observations. There are approximations and simplifications that transform the original model into one that is both practical and effective. In the preferred embodiment, the following simplifying assumptions are made:

1. The estimated distance, d, and the observation, v, are not specified stochastically as distributions, but are reported as scalar values produced by tempo estimation and signal processing algorithms, respectively. This reduces the dimensionality of the model, thus simplifying each update of the score position density.
2. The observation, v, depends only on the destination position, i, and is independent of both the performer's previous score position,j, and the estimate of the score distance, d. This assumption is not completely accurate. However, to the extent that the performer renders the score in a highly sequential fashion and the model updates occur frequently enough so that d always assumes a value within a small range, this simplification is likely to be reasonable.
3. Under assumption 2, $f_{J|D,V}=f_{J|D}$. It is further assumed that the score position density resulting from the previous model update is a reasonable approximation to $f_{J|D}$ for the given value of d. Thus, the previous estimate of the performer's location $f_{Source}(j)$ is substituted for $f_{J|D,V}(j|d,v)$ in the previous integral.
4. A distribution describing the actual amount of score performed by the vocalist between updates of the score position density is independent of the performer's source location. It only depends on the estimated score distance, d. This allows the performer's motion through the score to be modeled as a convolution integral.

While none of these assumptions is completely accurate, in combination they yield a reasonable approximation to the general score following model. This simplified model can be more easily specified and permits for a more efficient computer implementation. It can be understood by those skilled in the art that alternative methods may be applied. For example, instead of modeling a performer's motion through the score as a convolution integral, the prior score position density function can be shifted to account for the time delay without taking into account tempo estimation uncertainty. The tempo uncertainty could also be approximated by, for example, local averaging or approximating the convolution with a simpler filtering operation.

Under the four stated assumptions, the model for score following can be decomposed into two parts. First, an estimate of current location based on prior location and estimated distance can be calculated by convolving a tempo uncertainty function, $f_{I-J|D}(i-j|d)$, with the source location function, $f_{source}(j)$.

$$f_{I|D}(i \mid d) = \int_{i=0}^{|Score|} f_{I-J|D}(i-j \mid d) \cdot f_{source}(j) \partial j \tag{3}$$

Figure 4C:
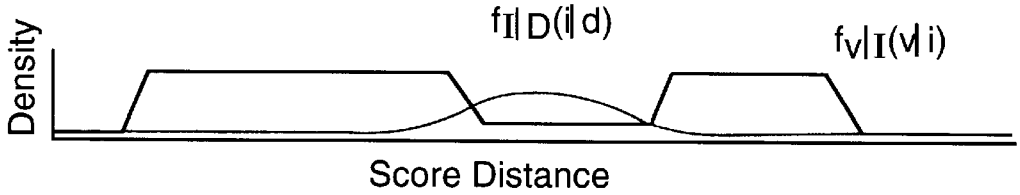
FIG. 4C illustrates the function which results from evaluating the convolution integral and an observation density function.
Figure 4D:
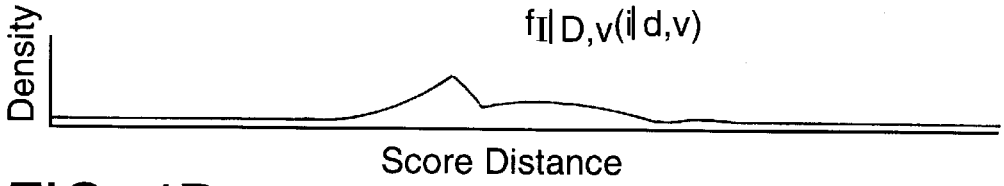
FIG. 4D illustrates a final score position density function.

The effect of the convolution is to shift the source location function by d and to "smear" the source location to reflect uncertainty in the exact value of d, as illustrated in FIGS. 4B and 4C. Next, this estimate can be modified to account for the most recent observation:

$$f_{I|D,V}(i \mid d, v) = \frac{f_{V|I}(v \mid i) \cdot f_{I|D}(i \mid d)}{\int_{k=0}^{|Score|} f_{V|I}(v \mid k) \cdot f_{I|D}(k \mid d) \partial k} \tag{4}$$

The result is a score position density conditioned on both the estimated distance and the most recent observation. Note that if d and v represent fixed values (as previously assumed), the result is a one-dimensional function over score position.

The following density functions are assumed to be predefined prior to each application of the model:

1. $f_{Source}$—The stochastic estimate of the performer's source position based on the observation and the score position density function calculated at the time of the previous observation. Under assumption 3 above, this is the score position density function calculated at the time of the previous observation.
2. $f_{I-J|D}$—The probability that the performer has actually performed an amount of score I–J given D, a prediction of the amount of score performed.
3. $f_{V|I}$—The probability of making observation V when the performer is at position I. This function is specified by the observation distributions of the events that form the score.

The second and third functions can each be defined using one of three alternative methods. First, one can simply rely on intuition and experience regarding vocal performances, and estimate a density function that seems reasonable. Alternatively, one can conduct empirical investigations of actual vocal performances to obtain numerical estimates of these densities. Pursuing this further, one might actually attempt to model such data as continuous density functions whose parameters vary according to the conditioning variables. Theoretical descriptions of performance might be applicable in this case.

Direct execution of the simplified score following model requires the evaluation of two integrals. To allow for the widest range of possible density functions, the model is implemented numerically. The density functions are sampled (i.e. represented in point-value form) and the integrals approximated numerically. Because the first integral in the simplified model contains at least one function with two free variables, direct calculation of this integral would require time quadratic in the number of samples spanning the length of the score.

Fortunately, the first integral is a convolution integral. Numerical evaluation of this integral can be expedited through application of the discrete Fourier transform (DFT). It is a well-known property of this transform that discrete convolution, as results from numerical representation of the functions, can be calculated by first computing the discrete transforms of each function in the integral, calculating the product of these transforms, and then applying the inverse of the discrete transform to that product. For a transform of size N, this sequence of operations can be accomplished in time $\theta(N \log N)$. For calculating convolutions of even moderately large numbers of samples (e.g. $N \geqq 100$), this technique is noticeably faster than the direct approach.

Figure 5:
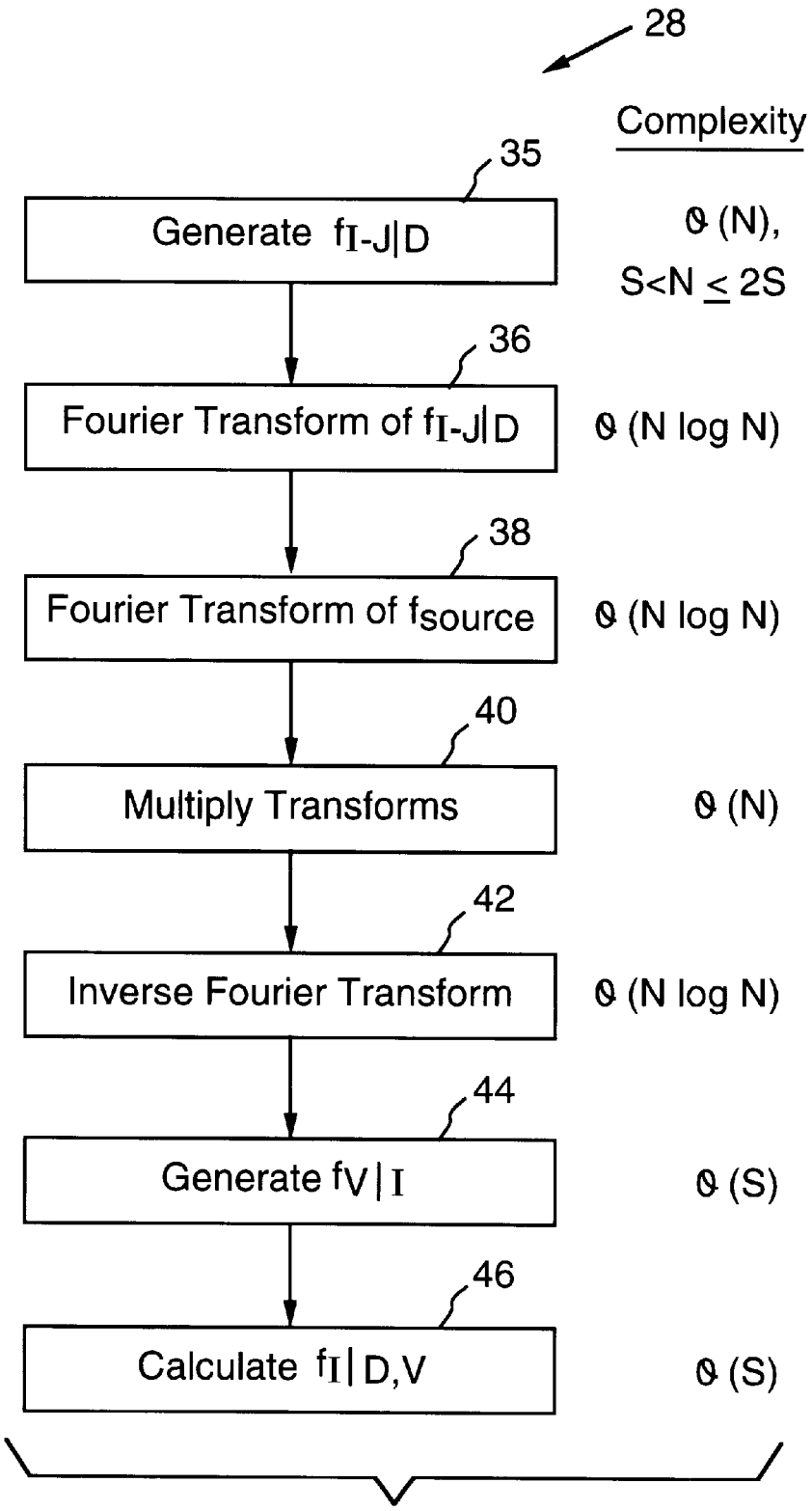
FIG. 5 is a flowchart illustrating a control flow of the various steps in a single application of the score position density update step of FIG. 1.

FIG. 5 is a flowchart showing a control flow of the various steps in a single application of the score position density update step 28 of FIG. 2. Also shown is the complexity of each step relative to the number of samples, S, along the score position dimension. Note that allowance is made for real-time generation (sampling) of both the distance density function, $f_{I-J|D}$, and the observation density, $f_{V|I}$. Computation of the Fourier transforms is the most cumbersome part of the process. Also, convolution via the DFT may require calculating transforms with as many as twice the number of points as the number of samples in the individual functions. This fact is reflected in the complexities shown in FIG. 5.

Turning to FIG. 5, at step 35 ($f_{I-J|D}$), the probability that the performer has actually performed an amount of score I–J given D, i.e., a prediction of the amount of score performed, is calculated. This step is described more fully hereinbelow in conjunction with FIG. 6. Step 36 in FIG. 5 starts the convolution process. The Fourier transform of the probability that the performer has actually performed an amount of score I–J given D ($f_{I-J|D}$) is calculated. The Fourier transform of the stochastic estimate of the performer's source position ($f_{source}$) is calculated at step 38. The transformed functions are multiplied at step 40 and the inverse Fourier transform of the resulting function is calculated at step 42. The probability of making observation V when the performer is at position I ($f_{V|I}$) is generated at step 44. The score position density which is conditioned on both the estimated distance and the most recent observation ($f_{I|D,V}$) is calculated at step 46.

If more than one observation variable is input, a joint density function that takes into account multiple observations and results in a single observation density function could be used. Alternatively, it could be assumed that the observation variables are independent, and an observation density function could be constructed for each variable. The functions would be multiplied and the resulting function would be rescaled such that it has an area of 1. If it is assumed that some variables are dependent and some are independent, the dependent variables could be grouped and observation density functions would be calculated for each group. The density function could be multiplied with any independent variable density function to result in one observation density function, which could be scaled to have an area of 1.

Figure 6:
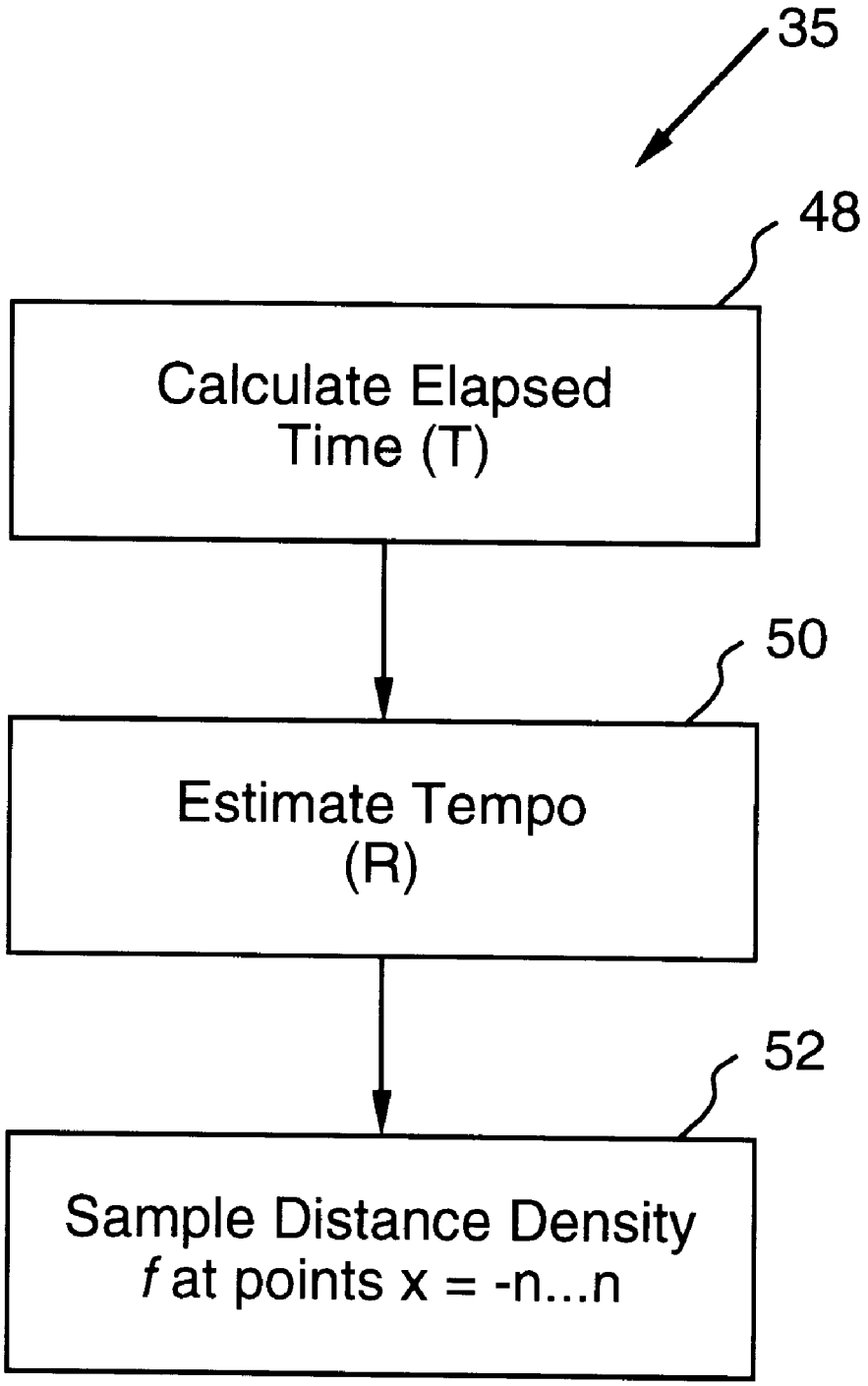
FIG. 6 is a flowchart illustrating a control flow of the step of generating the probability that the performer has actually performed an amount of score I–J given D, a prediction of the amount of score performed.

FIG. 6 illustrates a flowchart of a control flow describing the implementation of the step 35 of FIG. 5. At step 48, the elapsed time T is calculated using:

$$T = \langle \text{Current time} \rangle - \langle \text{Last time model was updated} \rangle \tag{5}$$

At step 50, the tempo R is estimated using:

$$R = \frac{\langle\text{Position at time } T2\rangle - \langle\text{Position at time } T1\rangle}{\langle\text{time } T2\rangle - \langle\text{time } T1\rangle}, \quad T2 > T1 \tag{6}$$

Where T1 and T2 are times of recent estimations of score position. At step 52, the sample distance density f at points X=−n . . . n could be estimated using, for example:

$$f(x \mid R \times T) = \frac{1}{x\sqrt{2\pi\sigma^2}} e^{\frac{-(\ln x-\mu)^2}{2\sigma^2}}, \tag{7}$$

$$\text{where } \sigma^2 = \frac{1}{.0297 \times T}, \mu = \ln R + \frac{1}{2}\sigma^2 - \ln T,$$

$$f_{I-J|D} = f(x \mid R \times T), D = R \times T$$

To achieve a tractable implementation, the score position density function is not calculated over the entire length of the score. Instead, the function is calculated over only a portion of the score, referred to as a window. Windowing of a score is a technique commonly used to implement automated accompaniment systems. For purposes of the stochastic model presented here, the score position density is either assumed to be zero outside of the window, or to be sufficiently close to zero as to be of no significance.

Each application of the model can produce an estimate of the score position density for a shifted window, encompassing a region slightly to the left or right of the previous window. Each update uses only those points of the score position density function that are contained within the window from the previous application of the model. The size and direction of the shift can be based upon changes, from window to window, in the region or regions of highest density. Thus, the window will essentially move through the score over time, following the performer.

Experimental Implementation

As a low-end test of this implementation, the model has been executed on a personal computer using an Intel 80486 processor at a clock speed of 66 MHz. Using double-precision floating point and DFT's with 512 points, one application of the model requires 35 ms of CPU time. Because the complexity of calculating the model is nearly linear in the size of the transform, a computing platform which is twice as fast permits a window encompassing twice as many points to be calculated in nearly the same time. Modern processors have enough power to extract features from an audio signal in addition to applying the model. The accompaniment can be generated using a sound card, external synthesizer, or direct sound synthesis by software for a complete accompaniment system.

Both the distance and observation density functions must be explicitly defined. One method of definition is described hereinbelow. Performances given by live vocalists singing with live accompanists are recorded. The vocal performances are recorded in isolation, using a highly directional microphone placed in close proximity to the singer. The recordings can thus be analyzed for both pitch content and tempo.

While many relevant features can be generated from a digitized waveform of a vocal performance, the initial implementation has focused only on fundamental pitch. The events for each musical score have an observation density that is conditioned on the pitch that is notated in the score. Thus, at present, all events that correspond to A-440 are associated with the same observation distribution. The relative length of the events is based upon an idealized tempo. Tempo changes that are explicitly marked in the score are used to calculate changes in the idealized tempo for different sections of score.

The definition of the density function $f_{I-J|D}$ will depend on how the estimated distance, d, is generated. The product of the most recent estimate of the performer's tempo (as used to control the accompaniment) and the elapsed time since the previous update of the score position density is computed. The distance density is conditioned on tempo and elapsed time. It changes for successive calculations of the score following model. Thus, to some degree, the score position density reflects changes in both the performer's tempo and the elapsed time between successive observations.

Eighteen performances were used to determine the observation density function. These recordings contained 2 performances by each of 9 singers encompassing all primary voice types and performing a total of 16 different compositions. Twenty performances were used to estimate the distribution of the actual amount of score performed conditioned on the estimated distance. These recordings contained 2 performances by each of 10 singers, again encompassing all primary voice types and performing a total of 16 different compositions. We believe the resulting empirical density functions to be fair approximations to the respective distributions in the limit for a target population of performances of classical music given by trained singers.

The pitch detection algorithm is based on one described in Kuhn, "A Real-time Pitch Recognition Algorithm for Music Applications," Computer Music Journal, vol. 14, no. 3, pp. 60–71, which is incorporated herein by reference. It uses a bank of lowpass filters spaced at half-octave intervals along the range of the vocalist's part. Bass boost is applied to an analog audio signal via an external mixer. The audio is digitized at 15 KHz by a PC sound card and analyzed in 33 ms blocks. Level control is applied to the blocks prior to filtering. The output of each filter is sent through a zero-crossing detector to determine average pitch period. Maximum amplitude is also determined. Average fundamental pitch for a block is taken from the filter with lowest cutoff frequency whose maximum amplitude exceeds 25% of the maximum amplitude over all filters.

A preset amplitude threshold is used to distinguish the pitched signal of interest from blocks containing silence, breathing, consonants in the singing, and low-level background noise. The detector reports the median pitch over every 3 consecutive blocks of pitched signal. Thus, during a sustained tone, the detector reports pitch at a rate of 10 Hz.

The 20 recorded performances were played from a DAT tape and processed by the pitch detector. The output was parsed manually to time align the reported pitches with the notes in the scores. This parsing process relied on information about silences and pitch in the detector output, as well as occasional graphical examination of digitized waveforms of the recordings. Next, the distance (in semitones) between the detected pitch and the scored pitch was calculated for the 18 performances. This provided an observation distribution for actual pitch given a scored pitch.

Similarly, the distance density was modeled using all 20 performances. Using the time aligned parses of the pitch output, the performer's tempo was calculated over short consecutive regions of score. This data was used to model the distribution of the subsequent score distance performed given a previous short-term tempo and a known elapsed time. In contrast to the model for pitch, the distance density is continuous and based upon convolution of lognormal density functions. Lognormal density functions have two parameters, $\mu$ and $\sigma^2$ (See equation 7). From the data, $\sigma^2$ was defined as $$\frac{1}{.0297 \times T}$$

where T is elapsed time and $\mu$ was defined as $\ln R - \frac{1}{2}\sigma^2 + \ln T$, where R is the estimated tempo (See Equation 6).

There is a need for a precise interpretation of probability as computed by the model. For purposes of a general accompaniment system, the probability specified by the score position density is viewed as a frequency count. More specifically, the probability over a region of score indicates the relative number of performances from a target population of performances which, having produced the sequence of observations and tempo estimates so far generated, will find the performer within that region: Thus, the purpose of statistical modeling, in both the theoretical and empirical aspects, is to identify a tractable model which closely approximates the actual position distribution among the target population of performances.

Next, because an accompaniment system must control the performance of the accompaniment, a method of using the stochastic description of the vocalist's score position to select an accompaniment control action is needed. One possibility is to apply a decision-theoretic approach. This requires the definition of a loss function. For every possible position of the performer, this function would quantify the relative, negative impact of taking a particular accompaniment control action. The probabilistic description of a vocalist's position could be used in combination with the loss function to determine an action that would probabilistically minimize the expected loss (negative impact) over repeated selection of control actions over multiple performances.

However, specification of such a loss function is non-trivial. Currently, a simplified approach is used. The score following system finds the 100 ms region of the score that is most likely to encompass the performer's current position. This region is the 100 ms portion of the score position density function containing the highest probability. The accompaniment system takes the center of this region as a best estimate of the current position of the vocalist. It synchronizes to this position using a set of performance rules almost identical to those described in Grubb, et al., "Automating Ensemble Performance", Proc. of the 1994 Intl. Computer Music Conference, 1994, pp. 63–69, which is incorporated herein by reference. The performance rules of the present invention differ from those of Grubb, et al. in that when the accompaniment system is judged to be ahead of the live performers, it will either slow down or pause, rather than always pausing, depending on the magnitude of the score position difference. Thus, the system will synchronize to the position most likely to be within 50 ms of the performer's location. The accompaniment system retains several successive position estimates for use in calculating a recent tempo. The system adjusts its tempo incorporated and score position depending upon how closely the estimates of the performer's location and tempo correspond with its own current position and tempo.

The stochastic score following model has been incorporated as part of an automated accompaniment system. It uses a sample interval of 12 ms to represent the score position density function and responds to output from the pitch detection system previously described. This completed accompaniment system has been used to accompany both recordings of vocal performances and live singers.

While generated accompaniment is often reasonable, there are situations where the computer and singer are temporarily but noticeably not synchronized. These problems commonly occur in the presence of sudden, significant tempo changes that are not explicitly notated in the score. Such changes are especially troublesome if they occur while the performer is singing a sequence of notes on the same pitch. Intentional pitch changes for expressive purposes (like ornaments) are also problematic, because the actual observed pitches are given low likelihood by the observation distributions based on the score.

In instances where the vocalist intentionally and consistently modifies the performance in these ways, adjusting the event durations and the observation distributions by hand, by heuristics, or by machine learning techniques can often improve the computer's ability to track the performer. Also, because pitch and estimated tempo are not always sufficient to distinguish score position, extensions to the module 18 that include other relevant features from the performance may be incorporated. Examples include changes in amplitude indicative of note onsets and spectral features useful for speech recognition.

While the present invention has been described in conjunction with preferred embodiments thereof, many modifications and variations will be apparent to those of ordinary skill in the art. For example, in addition to musical accompaniment applications, the present invention may be used in conjunction with applications such as, for example, music analysis, education and coaching, and synchronization of audio with video. The foregoing description and the following claims are intended to cover all such modifications and variations.

What is claimed is:

1. A computer implemented method for stochastic score following, comprising the steps of:

receiving a performance signal;

calculating a probability function over a score based on at least one observation extracted from said performance signal; and determining a most likely position in said score based on said calculating step.

2. The method of claim 1 further comprising the step of estimating a tempo of said performance signal.

3. The method of claim 2 further comprising the step of outputting an accompaniment based on said most likely position and said estimated tempo.

4. The method of claim 1 wherein said step of determining a most likely position includes the steps of calculating an updated score position density function and selecting said most likely position based on said updated score position density function.

5. The method of claim 4 wherein said step of calculating an updated score position density function comprises the steps of:

generating a probability function representing a probability that an amount of said score has been performed;

convolving said probability function with a current position estimate function to produce a function representing a preliminary score position density function; and multiplying said preliminary score position density function with a function specifying a probability of making said observation at a certain position in said score to create said updated position density function.

6. The method of claim 5 wherein said step of convolving said probability function comprises the steps of:

calculating a first Fourier transform of said probability function;

calculating a second Fourier transform of said current position estimate function;

multiplying said first and second Fourier transforms to create a multiplied function; and computing an inverse Fourier transform of said multiplied function to create said probability of making said observation at a certain position in said score.

7. The method of claim 5 wherein said step of generating a probability function includes the steps of:

calculating an elapsed time representing the difference between the time associated with said observation and the time when said probability function was last generated;

estimating a tempo of said performance signal based on said elapsed time, said most likely position, and a previous most likely position; and calculating a sample distance density function based on said elapsed time and said estimated tempo.

8. The method of claim 2 wherein said step of estimating a tempo includes the step of estimating a tempo based on said most likely position and a prior most likely position.

9. The method of claim 3 wherein said step of outputting an accompaniment includes the steps of comparing said most likely position and said estimated tempo to a previous most likely position and estimated tempo, respectively, and determining an accompaniment based on said comparison.

10. A stochastic score following system, comprising:

a processor;

at least one sensor for receiving an input signal from an input device and for extracting at least one observation from said input signal;

a communication link enabling communications between said processor and said input device; and a memory, coupled to said processor, and storing a set of ordered data and a set of instructions which when executed by said processor cause said processor to perform the steps of:

calculating a probability function over a score based on at least one observation extracted from a performance signal; and determining a most likely position in said score based on said calculating step.

11. The system of claim 10 wherein said memory includes an additional set of instructions which, when executed by said processor, cause said processor to perform the step of estimating a tempo of said performance signal.

12. The system of claim 11 wherein said memory includes an additional set of instructions which, when executed by said processor, cause said processor to perform the step of outputting an accompaniment based on said most likely position and said estimated tempo.

13. The system of claim 10 wherein said memory includes an additional set of instructions which, when executed by said processor, cause said processor to perform the step of determining a most likely position by performing the steps of calculating an updated score position density function and selecting said most likely position based on said updated score position density function.

14. The system of claim 13 wherein said memory includes an additional set of instructions which, when executed by said processor, cause said processor to perform the step of calculating an updated score position density function by performing the steps of:

generating a probability function representing a probability that an amount of said score has been performed;

convolving said probability function with a current position estimate function to produce a function representing a preliminary score position density function; and multiplying said preliminary score position density function with a function specifying a probability of making said observation at a certain position in said score to create an updated score position density function.

15. The system of claim 14 wherein said memory includes an additional set of instructions which, when executed by said processor, cause said processor to perform the step of convolving said probability function by performing the steps of:

calculating a first Fourier transform of said probability function;

calculating a second Fourier transform of said current position estimate function;

multiplying said first and second Fourier transforms to create a multiplied function; and computing an inverse Fourier transform of said multiplied function to create said probability of making said observation at a certain position in said score.

16. The system of claim 14 wherein said memory includes an additional set of instructions which, when executed by said processor, cause said processor to perform the step of generating a probability function by performing the steps of:

calculating an elapsed time representing the difference between the time associated with said observation and the time when said probability function was last generated;

estimating a tempo of said performance signal based on said elapsed time, said most likely position, and a previous most likely position; and calculating a sample distance density function based on said elapsed time and said estimated tempo.

17. The system of claim 11 wherein said memory includes an additional set of instructions which, when executed by said processor, cause said processor to perform the step of estimating a tempo by performing the step of estimating a tempo based on said most likely position and a prior most likely position.

18. The system of claim 12 wherein said memory includes an additional set of instructions which, when executed by said processor, cause said processor to perform the step of outputting an accompaniment by performing the steps of comparing said most likely position and said estimated tempo to the previous most likely position and estimated tempo, respectively, and determining an accompaniment based on said comparison.

19. A musical accompaniment system, comprising:

a first circuit for receiving a performance signal and for extracting at least one observation from said performance signal;

a second circuit responsive to said first circuit, said second circuit for calculating a probability function over a score;

a third circuit responsive to said second circuit, said third circuit for determining a most likely position in said score based on said probability function;

a fourth circuit responsive to said third circuit, said fourth circuit for estimating a tempo of said performance signal; and a fifth circuit responsive to said third circuit and said fourth circuit, said fifth circuit for outputting an accompaniment based on said most likely position and said estimated tempo.

20. A musical accompaniment system, comprising:

at least one input sensor for receiving an input signal from an input device and for extracting at least one observation from said input signal, said input signal representing a sample of a musical performance signal;

a stochastic score follower module responsive to said input sensor, said stochastic score follower module for calculating a probability function over a musical score based on the observation and for determining a most likely position in said score based on said probability function;

an estimator module responsive to said stochastic score follower module, said estimator module for estimating a tempo of said performance signal based on said most likely position and a prior most likely position; and a scheduler module responsive to said stochastic score follower module and said estimator module for comparing said estimated tempo and said most likely position to a tempo and to a position in said score that is being played by an output device.

21. A stochastic score follower module, comprising:

a first sequence of instructions for receiving at least one observation;

a second sequence of instructions for calculating a probability function over a score based on said observation; and a third sequence of instructions for determining a most likely position in said score based on said probability function.

22. The stochastic score follower module of claim 21 further comprising a third sequence of instructions for estimating a tempo of said performance signal.

23. A computer-readable medium having stored thereon instructions which, when executed by a processor, cause the processor to perform the steps of:

calculating a probability function over a score based on at least one observation extracted from a performance signal; and determining a most likely position in said score based on said calculating step.

24. The computer-readable medium of claim 23 having stored thereon additional instructions which, when executed by a processor, cause the processor to perform the steps of:

estimating a tempo of said performance signal; and outputting an accompaniment based on said most likely position and said estimated tempo.

25. The computer-readable medium of claim 23 having stored thereon additional instructions which, when executed by a processor, cause the processor to perform the step of determining a most likely position by performing the steps of calculating an updated score position density function and selecting said most likely position based on said updated score position density function.

26. The computer-readable medium of claim 25 having stored thereon additional instructions which, when executed by a processor, cause the processor to perform the step of calculating an updated score position density function by performing the steps of:

generating a probability function representing a probability that an amount of said score has been performed;

convolving said probability function with a current position estimate function to produce a function representing a preliminary score position density function; and multiplying said preliminary score position density function with a function specifying a probability of making said observation at a certain position in said score to create an updated score position density function.

27. The computer-readable medium of claim 26 having stored thereon additional instructions which, when executed by a processor, cause the processor to perform the step of convolving said probability function includes the steps of:

calculating a first Fourier transform of said probability function;

calculating a second Fourier transform of said current position estimate function;

multiplying said first and second Fourier transforms to create a multiplied function; and computing an inverse Fourier transform of said multiplied function to create said probability of making said observation at a certain position in said score.

28. The computer-readable medium of claim 26 having stored thereon additional instructions which, when executed by a processor, cause the processor to perform the step of generating a probability function by performing the steps of:

calculating an elapsed time representing the difference between the time associated with said observation and the time when said probability function was last generated;

estimating a tempo of said performance signal based on said elapsed time, said most likely position, and a previous most likely position; and calculating a sample distance density function based on said elapsed time and said estimated tempo.

29. The computer-readable medium of claim 24 having stored thereon additional instructions which, when executed by a processor, cause the processor to perform the step of estimating a tempo by performing the step of estimating a tempo based on said most likely position and a prior most likely position.

30. The computer-readable medium of claim 24 having stored thereon additional instructions which, when executed by a processor, cause the processor to perform the step of outputting an accompaniment by performing the steps of comparing said most likely position and said estimated tempo to a previous most likely position and estimated tempo, respectively, and determining an accompaniment based on said comparison.

31. A stochastic score follower module, comprising:

means for receiving at least one observation;

means for calculating a probability function over a score based on said observation; and means for determining a most likely position in said score based on said probability function.

32. A musical accompaniment system; comprising:

a processor;

at least one sensor for receiving an input signal from an input device and extracting at least one observation from said input signal;

a communication link enabling communications between said processor and said input device; and a memory, coupled to said processor, and storing a set of ordered data and a set of instructions which when executed by said processor cause said processor to perform the steps of:

calculating a probability function over a musical score based on at least one observation extracted from a musical performance signal;

determining a most likely position in said musical score based on said calculating step;

estimating a tempo of said musical performance signal; and outputting a musical accompaniment based on said most likely position and said estimated tempo.

* * * * *